US006247413B1

(12) United States Patent
Teichmann

(10) Patent No.: US 6,247,413 B1
(45) Date of Patent: Jun. 19, 2001

(54) TRUCK FRAME FOR RAILWAY ROLLING STOCK

(75) Inventor: Martin Teichmann, Graz (AT)

(73) Assignee: Siemans SGP Verkehrstechnik GmbH, Vienna (AT)

( * ) Notice: Subject to any disclaimer, the term of this patent is extended or adjusted under 35 U.S.C. 154(b) by 0 days.

(21) Appl. No.: 09/319,537

(22) PCT Filed: Dec. 3, 1997

(86) PCT No.: PCT/AT97/00269

§ 371 Date: Aug. 6, 1999

§ 102(e) Date: Aug. 6, 1999

(87) PCT Pub. No.: WO98/26970

PCT Pub. Date: Jun. 25, 1998

(30) Foreign Application Priority Data

Dec. 19, 1996 (AT) ..... 2229/96

(51) Int. Cl.[7] ..... B61F 5/00
(52) U.S. Cl. ..... 105/199.1
(58) Field of Search ..... 105/157.1, 172, 105/182.1, 197.05, 199.1, 199.2, 199.3

(56) References Cited

U.S. PATENT DOCUMENTS 3,818,841 * 6/1974 Julien ..... 105/199.1
4,363,277 * 12/1982 Martin et al. ..... 105/199.1
5,222,440 * 6/1993 Schneider ..... 105/199.2
5,255,611 * 10/1993 Schneider ..... 105/199.2
5,564,342 * 10/1996 Casetta et al. ..... 105/199.2
5,671,683 * 9/1997 Parussatti et al. ..... 105/199.2
5,970,883 * 10/1999 Nast ..... 105/199.2

* cited by examiner

*Primary Examiner*—Mark T. Le
(74) *Attorney, Agent, or Firm*—Clark Hill PLC

(57) ABSTRACT

The present invention pertains to a truck frame for railway rolling stock with a two-axle undercarriage secured by means of a primary suspension to a frame on which, through the intermediate setting (28, 29) of a secondary suspension, a hinged bracket (30) is mounted, transversally oriented relative to the direction of movement, said hinged bracket (30) being attached through oscillation about an axle oriented longitudinally relative to the car to an inclinable cross-bar bearing the car body. This cross-bar is designed as a frame and has two crossbearers (46, 47) mounted prior to or past the hinged bracket (30), while the crossbearers (46, 47) take their bearing against the hinged bracket in direction of movement and are mounted transversally mobile relative to direction of movement. Furthermore, the crossbar has preferably a central segment (50, 51, 52) connected to the frame (2) of the undercarriage to absorb the longitudinal forces through a guide in the form of a lemniscate, so that the cross-bar (31) can rotate about a substantially vertical axis and hinge in a substantially transversal plane relative to the direction of movement.

26 Claims, 6 Drawing Sheets

TRUCK FRAME FOR RAILWAY ROLLING STOCK

BACKGROUND ART

1. Field of the Invention

The invention relates to a pivoted bogie running gear for a rail-borne vehicle, and in particular, for a high speed train.

2. Description of the Related Art

A running gear of the above mentioned type is described for example in DE-C-2 145 738 in two different embodiments. The secondary spring system for the pendulum carrier is generally formed by air springs which sit on the frame of the running gear and support the pendulum carrier in the region of its lateral ends. The cross piece is connected to the pendulum carrier by means of a mechanical articulated arrangement in such a manner as to be able to pivot about a horizontal pivot axis, such that the pivot axis lies in the region above the cross piece in the body, e.g., at the passenger level. As a consequence, the tilt mechanism can be operated with minimum force expenditure. If the pivot axis is disposed above or below the center of gravity of the vehicle, then this causes a restoring force to return the tilt mechanism to its starting position. Since the tilt mechanism is disposed mechanically above the air springs, the mechanism is only slightly stressed by vibrations as these are to a great extent absorbed by the primary and secondary spring system. However, a disadvantage of this arrangement resides inter alia in the fact that the tilt mechanism with the secondary spring system requires substantial overall height which has proved to be disadvantageous.

A similar running gear is evident in DE 43 43 998 A1, in which a vehicle body cross piece which is not in the form of a frame is disposed on the pendulum carrier in a pivotable manner but not in a displaceable manner.

A tilt-adjusting mechanism with a secondary spring system for a pivoted bogie of a rail-borne vehicle which facilitates a low overall height is illustrated and described inter alia in EP 736 437 and EP 736 438. This tilt-adjusting mechanism comprises a pendulum carrier with a secondary spring system, the vehicle body being articulated directly to the pendulum carrier by way of a four-bar articulation, wherein hydraulic cylinders/piston units engage the upper side of the pendulum carrier at its two ends, and are supported at the associated lateral walls of the body at a distance above the pendulum carrier. A considerable disadvantage of this construction resides inter alia in the fact that by integrating the tilt-adjusting mechanism in the body construction, less passenger space and consequently less space for the seats is available. Moreover, in the case of such a construction both the running gear and also the body must be manufactured and assembled at one site. In addition, the body must be dimensioned accordingly in order to absorb the forces which occur, so that the production costs of such a body are increased. Since the points at which the force is introduced for the tilt-adjusting mechanism are comparatively high and as a consequence the distance from the center of gravity of the vehicle is less, it is necessary in order to tilt the body to overcome greater forces in an undesired manner.

In the case of a running gear according to DE 2 001 282 A, a comparatively complicated suspension is provided which comprises not only pendulums, but also angular levers and a connecting rod gearing. Two outer-lying actuators are provided in front of and behind the frame respectively.

SUMMARY OF THE INVENTION AND ADVANTAGES

The invention relates to a pivoted bogie running gear assembly for a rail-borne vehicle and, in particular, a high speed train. The running gear assembly includes a two-axle traveling gear which is attached by way of a primary spring system to a frame. The frame is aligned transversely with respect to the longitudinal direction of the vehicle. The frame is connected to a transverse-lying cross piece by way of a four-bar articulation pendulum mounting in such a manner as to be able to pivot about an axis extending in the longitudinal direction of the vehicle. In the case of the four-bar articulation pendulum mounting, two pendulums are disposed in a trapezoidal manner—as seen from the front or from behind. The two pendulums are symmetrical with respect to the longitudinal middle plane of the running gear assembly. The lateral distance of the articulation points of the pendulum at the pendulum carrier is less than the lateral distance of the underlying articulation points of the pendulums at the cross piece. The body of the vehicle can be placed directly on the cross piece and an active tilt-adjusting device including at least one actuator, e.g., a cylinder/piston unit is disposed in a transverse manner with respect to the longitudinal direction of the vehicle and in a substantially horizontal manner.

It is therefore an object of the present invention to improve a pivoted bogie running gear for a rail-borne vehicle of the type mentioned in the introduction in such a manner that a compact arrangement requiring as little as possible overall length and height can be achieved while providing a clear and simple interface with the vehicle body.

This object is achieved in the case of a pivoted bogie running gear of the type mentioned in the introduction in accordance with the invention by virtue of the fact that the cross piece is in the form of a frame comprising two traverse crossbars which are aligned in a transverse manner with respect to the longitudinal direction of the vehicle and are disposed in front of or behind the pendulum carrier and that these traverse crossbars can be supported in the longitudinal direction of the vehicle on the pendulum carrier and are disposed thereon in such a manner as to be displaceable in a transverse manner with respect to the longitudinal direction of the vehicle. The frame-like arrangement of the cross piece for the vehicle body renders it possible for the pendulum carrier and the cross piece to nestle one inside the other and for them to be disposed at a substantially identical height, so that the overall height of the running gear can be considerably reduced without modifications to the vehicle body being required. By arranging the cross piece around the pendulum carrier in a frame-like manner the cross piece can be manufactured so as to be sufficiently stable yet requiring a small volume of space in the longitudinal direction, which also renders it possible to achieve a running gear which has a short overall length.

An advantageous design of the running gear in accordance with the invention can be achieved in practice by virtue of the fact that to support and guide the traverse crossbars on the pendulum carrier in each case two friction plates are disposed symmetrically with respect to the longitudinal middle plane of the running gear and opposite flying friction surfaces are provided on each traverse crossbar. These friction plates/this arrangement of friction surfaces renders possible sufficient longitudinal entrainment and can be achieved in the sense of the most compact structure possible requiring a small amount of space.

A particularly advantageous embodiment of the pendulum is produced if each pendulum is manufactured from a plurality of spring steel sheets which lie in a two-dimensional manner one against the other and are articulated to the pendulum carrier or the cross piece in each case by means of a common pin. Since the spring steel sheets are highly resistant to extension in their longitudinal direction, the pendulums can be of an extremely narrow structure which further improves the compactness of the running gear. Furthermore, the pendulums are elastic transverse to the direction of pull, i.e. in the longitudinal direction of the vehicle and thus provide in an advantageous manner a certain degree of elasticity to compensate the tolerances between the pendulum carrier and the crossbar.

The pins for the pendulums can be mounted on the pendulum carrier or the cross piece in each case by means of a slide or roller bearing. In practice, it is of advantage if the pendulum mounting comprises four pendulums disposed in pairs, two pendulums respectively being disposed one behind the other in the longitudinal direction of the running gear.

A space-saving, simple and inexpensive tilt-adjusting mechanism can be achieved within the scope of the present invention by virtue of the fact that the tilt-adjusting device comprises a single cylinder/piston unit which is disposed below the pendulum carrier, one end of the cylinder/piston unit being connected at a distance from the longitudinal middle plane to the pendulum carrier and the other end being connected on the opposite lying vehicle side at a distance from the longitudinal middle plane to the cross piece.

The compactness of the arrangement is further improved by virtue of the fact that the cross piece comprises a central middle section which connects the two crossbars below the pendulum carrier, which section is connected to the frame of the running gear for the purpose of receiving the longitudinal forces by way of a lemniscate guide in such a manner that the cross piece can rotate about a vertical axis and in the main can be deflected in a transverse manner with respect to the direction of travel. The cross piece thus forms a stable construction which encompasses the pendulum carrier apart from its upper side.

The pendulum carrier is connected to the frame of the running gear for the purpose of receiving transverse forces, which occur between the running gear and the vehicle body, in a manner known per se by way of an active transverse spring and damping system, wherein an active transverse spring and damping element is provided in each case in front of and behind the pendulum carrier and the spring and damping elements engage in the region of the longitudinal middle plane on the pendulum carrier. In a preferred embodiment of the running gear in accordance with the invention an orifice is provided for the purpose of connecting the pendulum carrier to the active transverse spring or damping system in the middle section of the cross piece and a connecting piece of the pendulum carrier is guided through said orifice towards the front or towards the rear respectively below the traverse crossbars. As a consequence, the transverse spring system can be disposed outside the nestling arrangement of the cross piece and the pendulum carrier on the frame of the running gear.

Furthermore, the pendulum carrier can be provided in the region of its lateral ends with a roll stabilizing system known per se, which comprises on both sides of the frame in each case a roll stabilizer lever disposed below the pendulum carrier, articulated about a horizontal transverse axis on the frame, aligned in the longitudinal direction of the vehicle and in a substantially horizontal manner. The said roll stabilizer levers are connected in each case by way of an upwardly directed pull-push rod to the associated end of the pendulum carrier, wherein the stabilizer levers disposed lying mutually opposite in a transverse manner with respect to the direction of travel are mutually connected in a resilient manner by means of a torsion rod. In order to enhance further the effect of the roll stabilizing system, in the case of a preferred embodiment of the running gear in accordance with the invention the stabilizer lever of the roll stabilizing system is supported on the frame by way of a damping device which engages the stabilizer lever at a distance from the articulated shaft of the stabilizer lever. For practical purposes it is advantageous if the roll stabilizing system is formed by means of four stabilizer levers and pull-push rods, in each case two stabilizer levers and pull-push rods being disposed one behind the other in the direction of travel and symmetrically with respect to the longitudinal middle of the running gear.

Furthermore, in the case of an advantageous embodiment of the running gear in accordance with the invention the cross piece is connected at its lateral ends in each case to the frame by way of a rotational movement damping device, which acts against the rotating outwards movement of the running gear, to absorb the rolling movements of the pivoted bogie.

The pendulum carrier lies in the region of its lateral ends in a manner known per se on the frame in each case by way of an air spring which forms the secondary spring system, the internal space of the hollow pendulum carrier being integrated in an advantageous manner as additional volume of the air springs into the secondary spring system.

In one embodiment where each axle of the running gear is provided with an electric drive, it has been established as being advantageous if this drive is disposed on the side of the wheel axle facing the pendulum carrier, since as a consequence a compact structure can be achieved with a low moment of inertia. Furthermore, it is of advantage to achieve a running gear which is as compact as possible if each wheel of the running gear is provided in each case with a wheel disc brake and the parts of the brake mechanism are disposed on the side of the wheel axle facing the pendulum carrier.

An advantageous embodiment of the frame is possible by virtue of the fact that the internal space of the hollow frame is connected at least in sections to the air springs and is integrated into the volume of the air springs, since this feature renders it possible to achieve a compact secondary spring system which requires little overall height.

BRIEF DESCRIPTION OF THE DRAWINGS

Further features and advantages of the invention are evident from the following description of a non-limiting exemplified embodiment for a pivoted bogie running gear, wherein reference is made in the description to the attached drawings, wherein.

Figure 1:
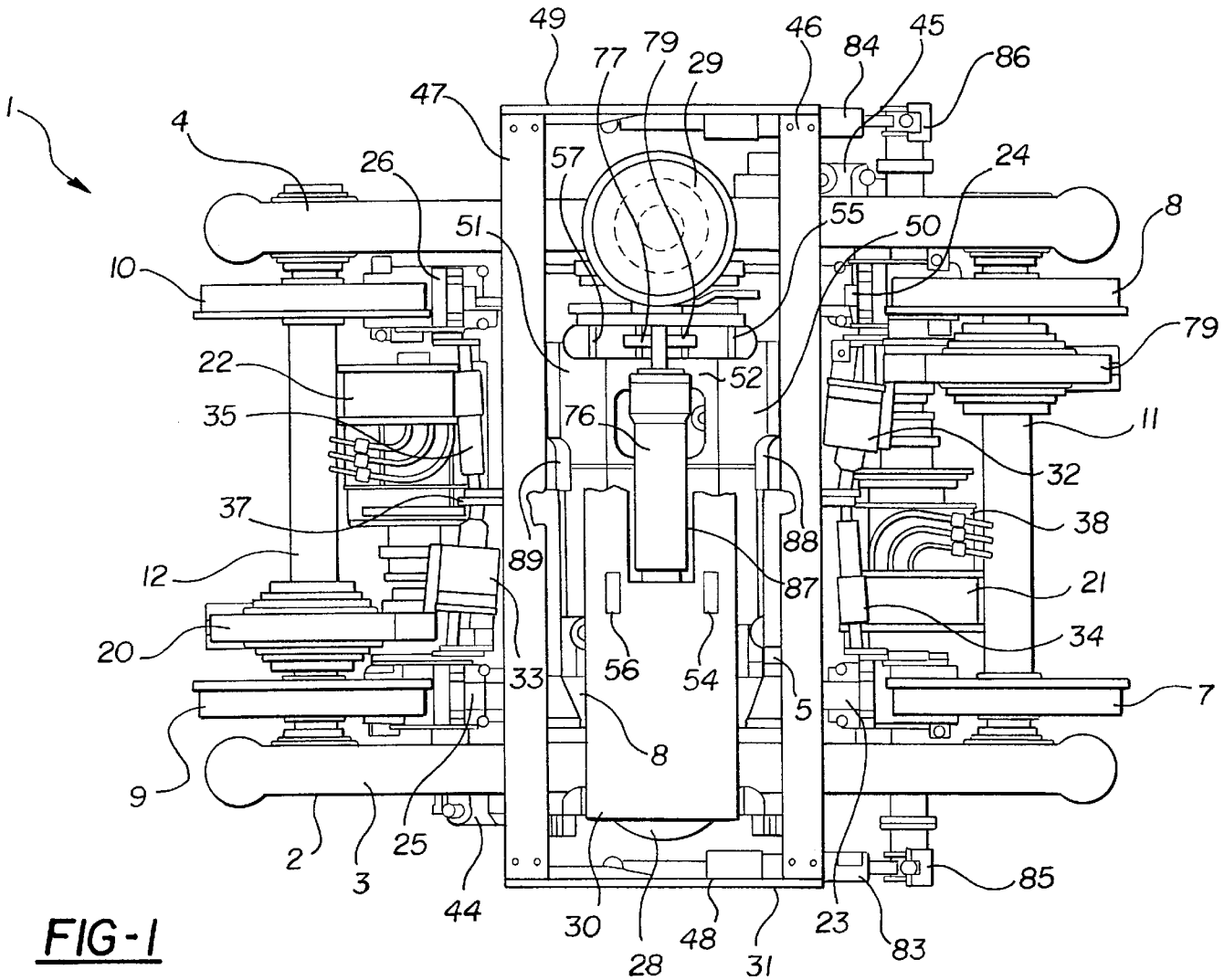
FIG. 1 is a schematic illustration of a plan view of a bogie of the type in accordance with the invention.
Figure 2:
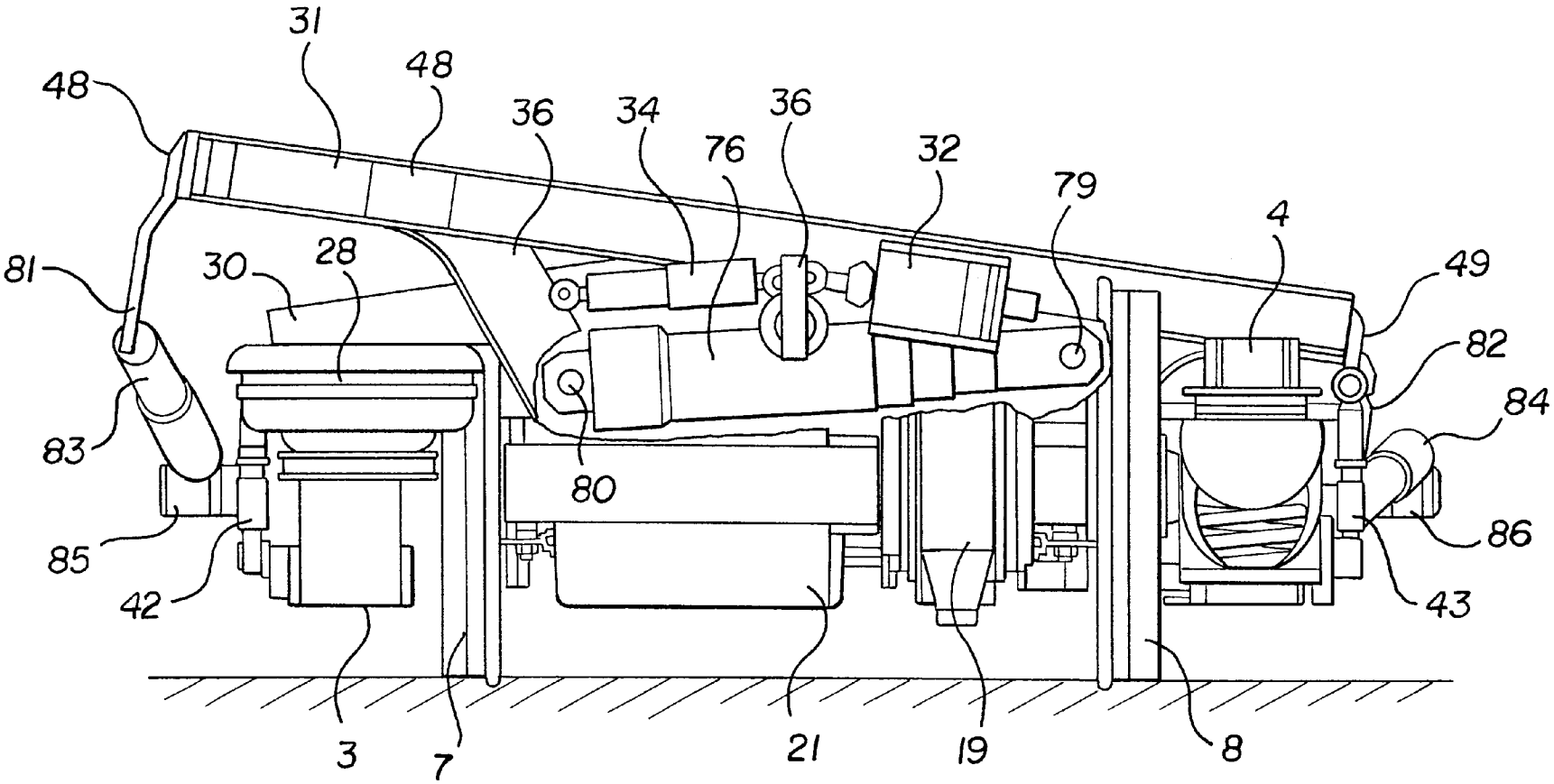
FIG. 2 is a schematic illustration from the front of the bogie as shown in FIG. 1.
Figure 3:
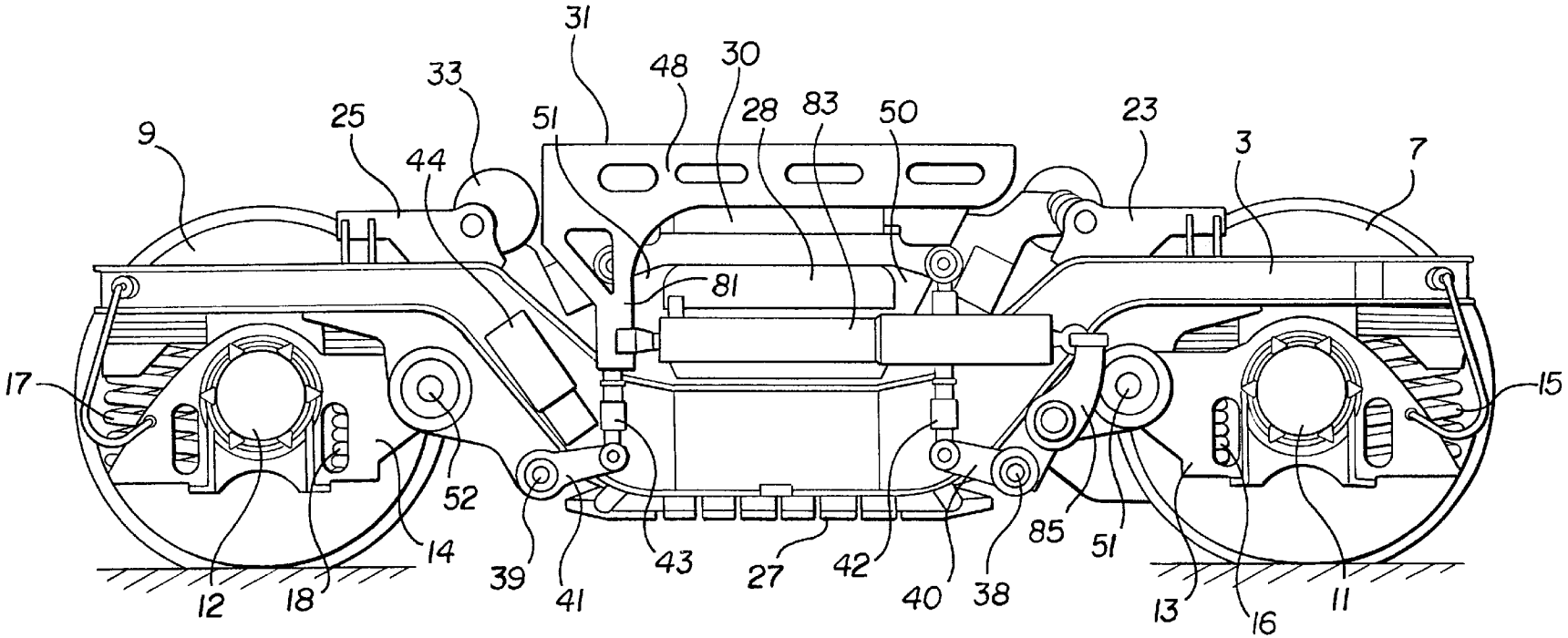
FIG. 3 is a schematic lateral view of the bogie as shown in FIGS. 1 and 2.
Figure 4:
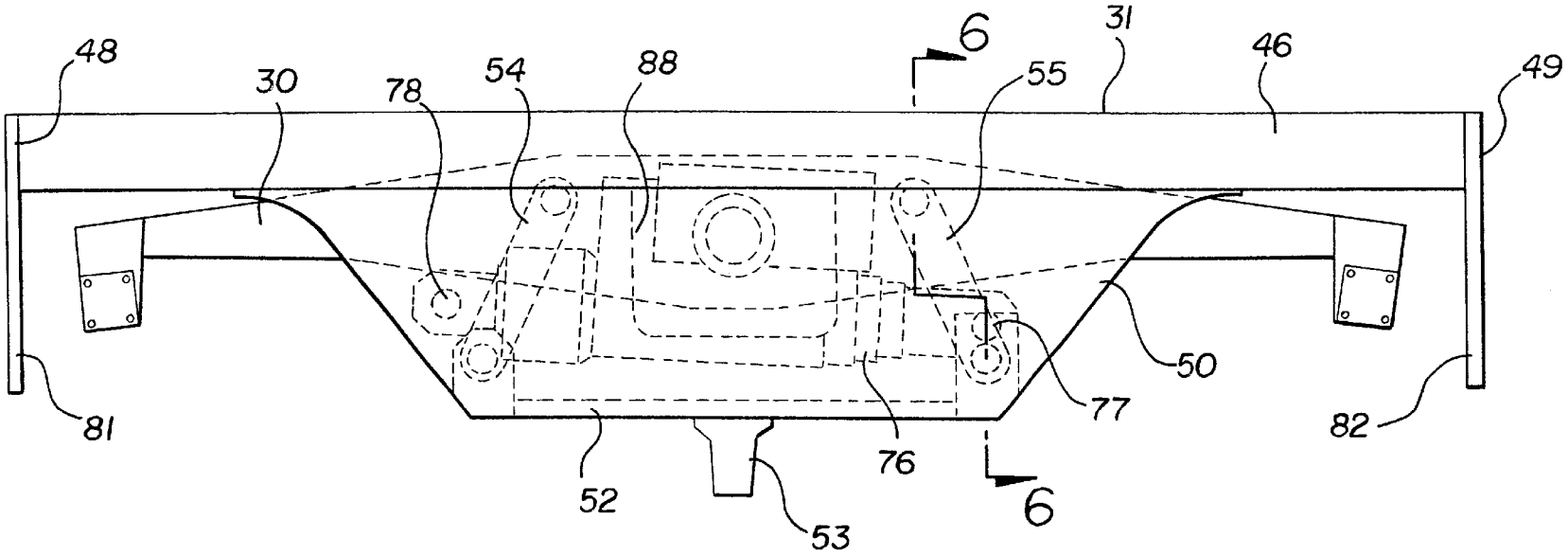
FIG. 4 is a partial view of the bogie as shown in FIG. 1 with the pendulum carrier and a view from above of the cross piece.
Figure 5:
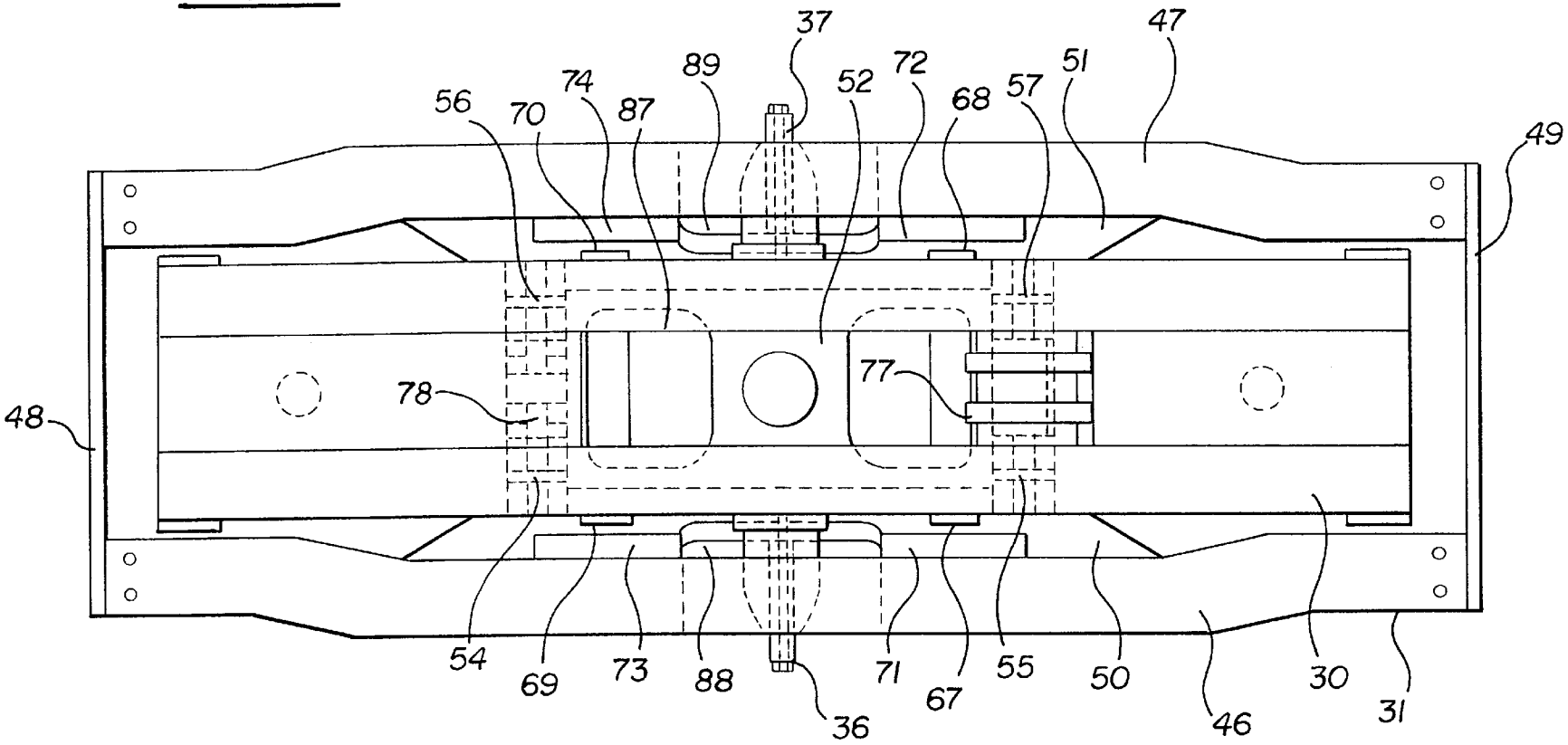
FIG. 5 is a the partial view in accordance with FIG. 4 viewed from the front.

Referring first to FIGS. 1 to 3 in which a pivoted bogie running gear 1 of the type in accordance with the invention is illustrated, the running gear 1 comprises an H-shaped frame 2 which is formed in each case by two longitudinal bars 3, 4 and in each case 2 crossbars 5,6 which are welded to each other. A wheel set which consists of two opposite lying wheels 7,8, 9,10 is provided in each case at the front and the rear end of the frame 2, the said wheels being mutually connected in a rigid manner by means of an axle 11, 12 respectively. The wheels 7,8,9,10 which are connected to the frame 2 by way of a primary spring phase are mounted in a rotatable manner in each case on a rocker 13,14 which is articulated to the longitudinal bars 3,4 of the frame 2 in such a manner as to pivot about a transverse axis S1, S2. The primary spring system is formed by two pressure-loaded helical springs 15, 16, 17, 18 per rocker 13, 14, the vertically disposed springs 15, 16, 17, 18 being supported with their lower end on the associated rockers 13, 14 and with their upper end against the associated longitudinal bar 3, 4 of the frame 2. The resilient constants are formed in dependence upon their distance from the oscillation axis S1, S2 such that upon compression of the primary spring system where possible no vertical forces occur on the oscillation axis S1, S2. The rocker mounting of the wheels by means of in each case two primary springs provides the advantage that the primary spring phase can be constructed in a compact manner and accordingly the running gear has a shorter overall height. Furthermore, the spring 16, 18 which has a smaller diameter creates additional space which can be used for the arrangement of a wheel disc brake.

The exemplified embodiment illustrated in the figures relates to a two-axle running gear, each axle being driven. For this purpose, a gearing 19, 20, e.g. a toothed-wheel gearing, which rides on the respective axle, is provided on the axles 11,12 and connected by way of a coupling, e.g. by way of a curved teeth coupling each with a transverse-lying drive motor 21, 22. The drive motors 21,22 are attached to the associated crossbar 5 or 6 of the frame 2 and the relative movements between the motor fixed to the frame and the gearing with the primary spring system are absorbed by the coupling. Drives of this type are known to the person skilled in the art in the field of pivoted bogie running gears and therefore are not described in detail at this point. However, to achieve a compact as possible running gear, in particular for high speed applications, it is essential to arrange all essential mechanical components of the gearing in each case on the side of the axes 11, 12 facing the longitudinal middle of the running gear.

The wheels 7,8,9,10 of the running gear 1 are provided in each case with a brake unit 23,24,25,26 of a so-called wheel disc brake. The brake units 23,24,25,26 are attached frame-fixed to the crossbars 5,6 of the frame 2 and each comprise brake pincers whose brake cheeks engage the lateral surfaces of the relevant wheels 7,8,9,10 which are provided on both sides in each case with a brake disc. Brake systems of this type are likewise already known by the person skilled in the art and accordingly are not explained in detail at this point. Within the scope of the present invention it is, however, essential in the sense of a compact structure that the mechanical components of the brake units 23,24,25,26 are disposed on the side of the wheels 7,8,9,10 facing the longitudinal middle of the running gear, since owing to a lower moment of inertia this arrangement has a favourable effect on the velocity limit of the vehicle.

A rail brake 27 is provided in each case on the lower side of the longitudinal bar 3,4 of the frame 2 in the region between the wheels 7,9, or 8,10.

An air spring 28,29 for the secondary spring system of the running gear 1 is disposed in each case on the upper side of the longitudinal bars 3,4 of the frame 2 in the region of the longitudinal middle of the running gear. A transverse-lying pendulum carrier 30 is placed on the air springs 28,29 which are disposed transversely opposite and the said pendulum carrier is connected by means of a pendulum arrangement to a likewise transverse-lying cross piece 31 in such a manner as to be able to pivot or tilt about a substantially horizontal longitudinal axis. A vehicle body (not illustrated) of the rail-borne vehicle can be placed on and attached to the said cross piece 31. The air springs 28,29 provide the secondary spring system with the advantage that as a result of the said springs being controlled the travel of the spring system is in the main not dependent upon the loading and as a consequence there is little rigidity. To achieve the greatest possible comfort for the occupants of the vehicle, it is absolutely necessary to provide a large air volume connected directly to the air springs. In the case of the exemplified embodiment illustrated, the inner space of the hollow frame 2 and the inner space of the likewise hollow pendulum carrier 30 are integrated at least in sections into the volume of the air springs 28,29, so that a particularly compact structure of the secondary spring system can be achieved with a small overall height.

The pendulum carrier 30 is provided in the exemplified embodiment illustrated with an active transverse spring system and a roll stabilizing system.

The transverse spring system disposed in the direction of travel both in front of and also behind the pendulum carrier 30 is formed in each case by means of an active spring element 32, 33 disposed in a transverse manner and in each case by a damping element 34, 35 disposed in a transverse manner, wherein the spring element 23, 33 is disposed at the side adjacent to the associated damping element 34, 35 and the elements 32, 34 and 33, 35 which are disposed adjacent to one another are supported with their ends remote from one another on the frame 2 of the running gear 1 and with their ends facing one another in the region of the longitudinal middle plane on a connecting part 36, 37 of the pendulum carrier 30. The transverse spring element 32 disposed in the direction of travel in front of the pendulum carrier 30 is provided for reasons of symmetry and stability on the diagonally opposite running gear side as the transverse spring element 33 disposed behind it. As a consequence, the damping elements 34, 35 are likewise disposed on the diagonally opposite running gear sides. The exact construction or control of a transverse spring system of this type is known to the person skilled in the art in the field of pivoted bogie running gears. With respect to an advantageous control of a transverse spring system reference is made to the European patent application with the publication number EP-A1-592 387 which is to be regarded specifically as a part of the present disclosure.

The roll stabilizing system of the pendulum carrier 30 comprises two torsion rods 38, 39 disposed transversely with respect to the running gear 1 and symmetrically to the longitudinal middle of the running gear. The said torsion rods are mounted with their ends in a rotatable manner on the longitudinal bars 3, 4 of the frame 2 and are connected in each case to a roll stabilizer lever 40, 41 which is aligned in a substantially horizontal manner and in the direction of the pendulum carrier, wherein the stabilizer levers 40, 41 are connected by means of upwardly protruding pull-push rods 42, 43 in an articulated manner to the outer ends of the pendulum carrier 30. The elements of the roll stabilizing system are disposed symmetrically both with respect to the longitudinal middle of the running gear and also with respect to the longitudinal middle plane of the running gear 1. As a consequence, each roll movement of the pendulum carrier 30 is transmitted by way of the rods 42, 43 and the stabilizer levers 40, 41 on both sides of the running gear in the opposite direction to the torsion rods 38, 39 and cushioned by the torsion effect of these rods. In addition to the cushioning of the roll movements of the pendulum carrier 30, in the case of one preferred embodiment of the pivoted bogie running gear 1 in accordance with the invention at least one damping device 44, 45 is provided on each side of the running gear and damps the outwards rotation of the torsion rods 38, 39 and thus the spring deflection of the running gear. The damping devices 44, 45 provided simply on each side are disposed in the illustrated exemplified embodiment of the running gear 1 diagonally opposite.

As can be seen in FIGS. 1 to 5, the cross piece 31 for the vehicle body is in the form of a frame and comprises two transverse crossbars 46, 47, which are disposed symmetrically with respect to the running gear middle and in accordance with the invention are disposed on both sides of the pendulum carrier 30 and in parallel therewith, and in each case two longitudinal struts 48, 49 which connect the outer ends of the traverse crossbars 46, 47. The pendulum carrier 30 is thus encompassed in a frame-like manner by the cross piece 31, so that in an advantageous manner it is possible to achieve a space-saving, namely both short and also low, structure of the running gear 1. Furthermore, the cross piece 31 comprises in the middle section in each case a section 50, 51 which protrudes downwards from the crossbar 46, 47, wherein the sections 50, 51 are formed running towards each other in a conical manner and are mutually connected at their lower ends by way of a connecting plate 52 which is substantially horizontal. Thus, the pendulum carrier 30 is encompassed substantially on all sides—apart from its upper side—by the cross piece 31. The special construction of the cross piece 31 as described above renders it possible for the said cross piece to be built so as to be sufficiently resistant to bending and twisting whilst requiring a small amount of space.

In order to transmit the longitudinal forces from the bogie 1 to the vehicle body a downwardly protruding spigot 53 is disposed on the connecting plate 52 of the cross piece 31, the said spigot being guided and held on the running gear by means of a so-called lemniscate guide. The lemniscate guide of the spigot 53 known per se and not illustrated in the figures comprises two longitudinal connecting rods which are aligned in the longitudinal direction and are disposed diagonally opposite on both sides of the longitudinal middle of the running gear and are articulated with their ends, which are remote from the longitudinal middle of the running gear, to the running gear frame. The ends of the longitudinal connecting rods facing the longitudinal middle of the running gear are mutually connected in an articulated manner by way of a transverse connecting rod which comprises a central bore for receiving the spigot 53. To provide a cushioning for any sudden longitudinal movements, the spigot 53 is held by way of a rubber element in the bore of the transverse connecting rod. The lemniscate guide renders it possible for the longitudinal forces to be transmitted as directly as possible from the running gear frame to the cross piece. Nevertheless, an outwards rotation, a vertically upwards and downwards movement and a lateral deflection of the cross piece or of the vehicle body with respect to the frame is possible.

The already mentioned pivotable mounting of the crossbar 31 on the pendulum carrier 30 is produced in the case of the running gear 1 of the type in accordance with the invention by means of a four-bar articulation which is achieved by pendulums 54, 55, 56, 57, two pendulums 54, 56 or 55, 57 respectively being disposed in each case at a spaced disposition one behind the other in the longitudinal direction and the opposite lying pendulums 54, 55 or 56, 57 respectively are disposed in a trapezoidal manner symmetrically with respect to the longitudinal middle plane. The pendulums 54, 55, 56, 57 are articulated at their upper end in each case by means of a pin to the pendulum carrier 30 and at their lower end in each case by means of a pin to the connecting plate 52 of the cross piece 31.

Figure 6:
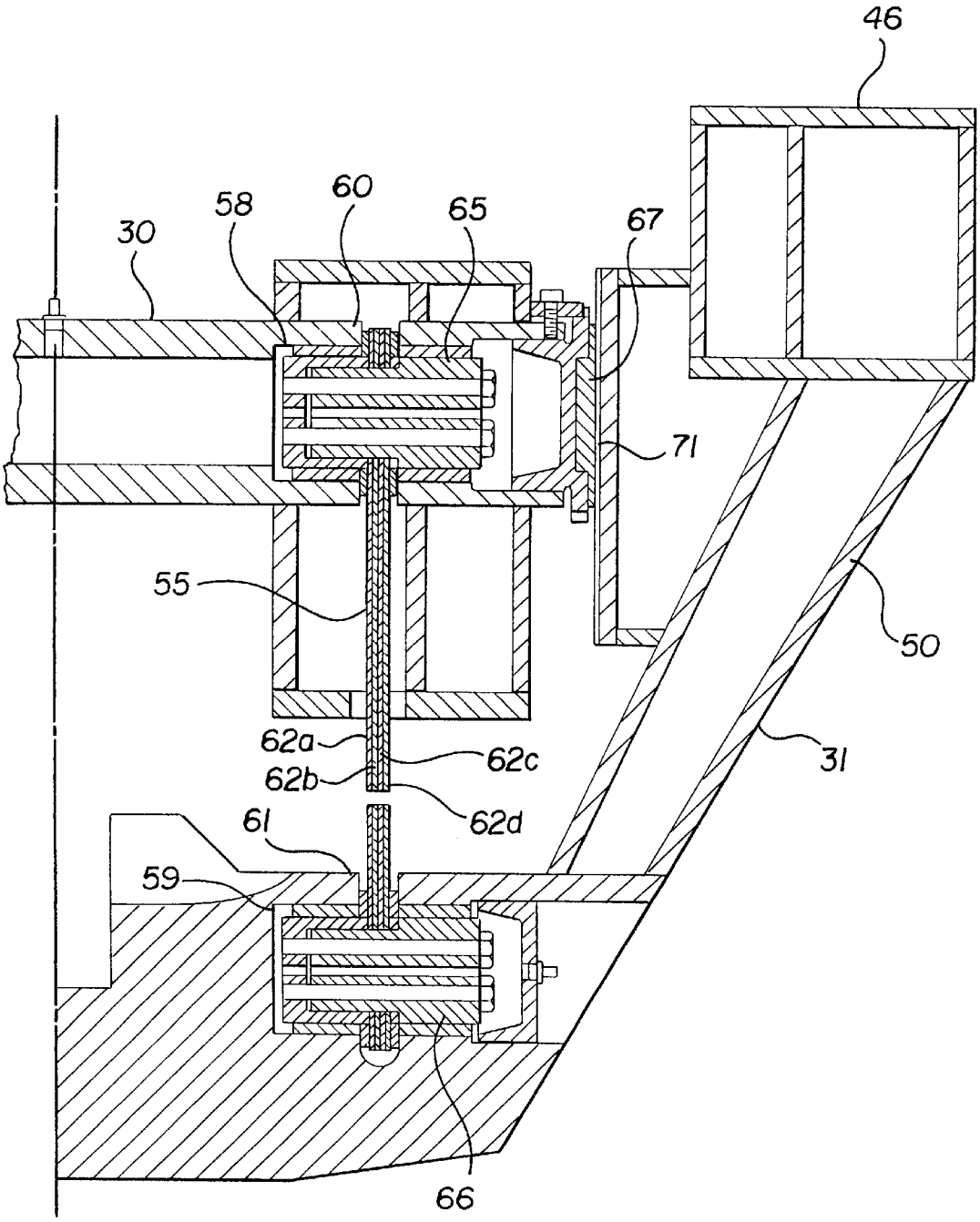
FIG. 6 is a cross-sectional view through the pendulum carrier and the cross piece along the line VI—VI of FIG. 4.

FIG. 6 illustrates in detail the articulation of the pendulum 55 to the pendulum carrier 30 and the cross piece 31. For this purpose lateral bores 58, 59 are provided both on the pendulum carrier 30 and also on the cross piece 31, the said bores being penetrated by slits 60, 61 for the pendulum 55. The pendulum 55 is formed by a plurality, e.g. four, spring steel plates 62*a*, 62*b*, 62*c*, 62*d*, which are joined together in a two-dimensional manner and are mutually connected in the region of their upper and lower ends in each case by means of two pins 65, 66. The advantage of this construction resides inter alia in the fact that the spring plates 62*a*, 62*b*, 62*c* 62*d* are highly resistant to extension in their longitudinal direction (vertically), yet are highly elastic transversely to their longitudinal direction (in the direction of travel), so that the cross piece can tilt in a precisely defined manner with respect to the pendulum carrier, but in the longitudinal direction a certain degree of elasticity for compensating movements within existing clearances or tolerances is possible. Owing to the fact that these pendulums are highly resistant to extension they can be accommodated in a particularly space-saving manner. As already mentioned, the two ends of the pendulum 55 are articulated in each case by means of a pin 65, 66 which is mounted in the associated bore 58, 59 in a precise fit in a respective slide bearing. As an alternative to a slide bearing, it is also possible to use a roller bearing within the scope of the present invention to mount the pin 65, 66. To facilitate the assembly process the pins 65, 66 are formed in two pieces in the case of the illustrated exemplified embodiment, the two parts which can be inserted one inside the other can be mutually connected by means of screws.

By pivoting the cross piece 31 with respect to the pendulum carrier 30 these are guided and supported against each other in accordance with the invention in the direction transverse with respect to the direction of travel. In the present exemplified embodiment this guide is formed on the one side by friction plates 67, 68, 69, 70 which are disposed on both sides of the pendulum carrier 30 at a distance from the longitudinal middle plane and symmetrical thereto, on the other side by slide surfaces 71, 72, 73, 74 of the cross piece 31 which are disposed opposite the friction plates 67, 68, 69, 70 on the associated traverse crossbars 46, 47. The exact design and arrangement of the friction plate 67 and the slide surface 71 in accordance with the exemplified embodiment is evident in FIG. 6. The friction plate 67 is received in a retaining piece 75 which is inserted in and attached to the bore 58 for the pendulum mounting. The slide surface 71 on the other hand is formed by a partial section, facing the friction plate 67, of the section 50, which protrudes conically downwards, of the cross piece 31.

By virtue of the pendulum mounting described above and illustrated in the figures when the cross piece 31 is tilted with respect to the pendulum carrier 30 the instantaneous pivot axis generally lies in the region above the centre of gravity of the vehicle. In the non-tilted starting position, the pivot axis lies in the longitudinal middle plane of the vehicle, whereas as the cross piece is tilted the pivot axis moves away from the longitudinal middle plane of the vehicle. The position away from the vehicle centre of gravity of the instantaneous pivot axis in the tilted state of the cross piece does, however, produce a predetermined restoring moment which automatically returns the vehicle or the cross piece back into its starting position or supports this return movement, so that as a consequence a passive tilt-reset of the vehicle body is possible.

For the purpose of tilting the cross piece 31 with respect to the pendulum carrier 30 a controllable actuator 76 is provided in accordance with the invention, this actuator in the case of the illustrated exemplified embodiment being achieved as a piston/cylinder unit which is disposed transverse with respect to the direction of travel and essentially lying below the pendulum carrier 30 and above the connecting plate 52 of the cross piece 31. At one end the actuator 76 is articulated at a distance from the longitudinal middle plane of the running gear by way of a bearing site 77 on the connecting plate 52 to the cross piece 31, whereas it is articulated at the other end on the opposite running gear side at a distance from the longitudinal middle plane by way of a bearing site 78 to the pendulum carrier 30. The actuator 76 is articulated to the bearing sites 77, 78 in each case by means of a pin 79, 80. By virtue of the particularly low-lying arrangement of the actuator 76 the points at which the force is introduced are located at a comparatively great distance from the vehicle centre of gravity, so that the inclination can be adjusted using only a small amount of force. This has a particularly advantageous effect on the dimensioning and the serviceable life of the entire tilt-adjusting mechanism (actuator, bearing sites, pins etc.) Furthermore, the entire tilt-adjusting mechanism in accordance with the invention is supported by way of the secondary spring phase (air springs 28, 29) on the running gear frame, so that it is essentially not necessary for the mechanism to absorb or transmit any vibrations or jerks from the running gear. This has an advantageous effect on the serviceable life and the operating safety of the tilt-adjusting mechanism. It is to be noted at this point that within the scope of the present invention any optional actuator can be used, provided that it can be installed and it functions in accordance with the above description. On the other hand, it is essential for the present invention that a single actuator is sufficient.

In the case of the pivoted bogie running gear 1 of the type in accordance with the invention the cross piece 31 together with the pendulum carrier 30 can rotate out with respect to the running gear frame 2 about a substantially vertical axis. For this purpose, the spigot 53 protruding downwards below the cross piece 31 from the connecting plate 52 is mounted in a rotatable manner in the lemniscate articulation described above. A return movement of this rotating out movement is achieved by virtue of the transverse rigidity of the air springs 28, 29. Furthermore, in the case of the illustrated exemplified embodiment a system of damping this rotating out movement is provided to absorb the rolling movements of the pivoted bogie. For this purpose, the traverse longitudinal struts 48, 49 are provided in each case with a downwardly protruding console 81, 82 which is connected in an articulated manner to one end of a horizontal damping element 83,84 which is aligned in the direction of travel. The other end of the damping element 83, 84 is attached to the associated longitudinal carrier 3,4 of the frame 2 in each case by way of a rigid rolling damping console 85, 86.

As already mentioned above, a connecting part 36, 37 which protrudes from the pendulum carrier 30 forwards or rearwards is provided in each case to connect the transverse spring and damping elements 32, 33, 34, 55 to the pendulum carrier 30. This connecting part 36, 37 is guided in the case of the present exemplified embodiment through an orifice 88, 89 respectively of the conical sections 50, 51 of the cross piece 31. When assembling the arrangement of the pendulum carrier 30 and the cross piece 31, the pendulum mounting is assembled first, after which the connecting parts 36, 37 can be attached to the pendulum carrier 30 via the orifice 88, 89 of the cross piece 31.

In the aforementioned description for the sake of simplicity inter alia terms such as vertical, horizontal, longitudinal middle plane, running gear longitudinal middle etc. are used. It goes without saying that the arrangement of features thus described always relates to the starting position of the running gear, i.e. the running gear is not pivoted nor tilted.

What is claimed is:

1. A pivoted bogie running gear assembly for a rail-borne vehicle, defining a longitudinal direction, said running gear assembly comprising:

a frame (2) defining a longitudinal axis;

a primary spring system secured to said frame (2);

a two-axle traveling gear secured to said primary spring system;

a secondary spring system (28, 29) interpositioned on said frame (2);

a pendulum carrier (30) supported by said secondary spring system (28, 29), said pendulum carrier (30) extending transverse the longitudinal direction of the vehicle;

a plurality of mounting pendulums (54, 55, 56, 67) extending out from said pendulum carrier (30), each of said plurality of mounting pendulums (54, 55, 56, 57) defines two ends with a first end of said two ends pivotally secured to said pendulum carrier (30) to define a first lateral distance between said first ends of a respective pair of said pendulums;

a transverse cross piece (31) pivotally connected to second ends of said mounting pendulums (54,55,56,57) to define a second lateral distance between said second ends of said respective pair of said pendulums; wherein, said second lateral distance is greater than said first lateral distance, said cross piece (31) including two traverse crossbars (46,47) extending transverse to the longitudinal direction of the vehicle and beyond said pendulum carrier (30) in front of and there behind, wherein, the two traverse crossbars (46, 47) are supported by said pendulum carrier (30).

2. A pivoted bogie running gear assembly as set forth in claim 1 including an actuator disposed between said pendulum carrier (30) and said transverse cross piece (31), said actuator extending substantially horizontally and in transverse manner with respect to the longitudinal direction of the vehicle.

3. A pivoted bogie running gear assembly as set forth in claim 2 including friction plates (67, 68, 69, 70) fixedly secured to said pendulum carrier (30) and disposed symmetrically with respect to said longitudinal axis of said frame.

4. A pivoted bogie running gear assembly as set forth in claim 3 including friction surfaces (71, 72, 73, 74) fixedly secured to said traverse crossbars (46, 47) disposed opposite each of said friction plates (67, 68, 69, 70).

5. A pivoted bogie running gear assembly as set forth in claim 4 wherein each of said mounting pendulums (55) is produced from a plurality of spring steel plates (62*a*, 62*b*, 62*c*, 62*d*), each of said plurality of spring steel plates (62*a*, 62*b*, 62*c*, 62*d*) abutting another.

6. A pivoted bogie running gear assembly as set forth in claim 5 including a common pin (65, 66) extending through all of said plurality of spring steel plates (62*a*, 62*b*, 62*c*, 62*d*) at each of said two ends of said mounting pendulums (55).

7. A pivoted bogie running gear assembly as set forth in claim 6 including a roller bearing substantially covering said common pin (65, 66) such that said roller bearing separates said common pin (65, 66) from said mounting pendulum (55) an d said traverse cross piece (31).

8. A pivoted bogie running gear assembly as set forth in claim 7 including four pendulums (54, 55, 56, 57) disposed in pairs symmetrically about said longitudinal axis of said pivoted bogie running gear assembly.

9. A pivoted bogie running gear assembly as set forth in claim 8 wherein said actuator includes a single cylinder/piston unit (76) disposed below said pendulum carrier (30), said cylinder/piston unit (76) extending across said longitudinal axis of said pivoted bogie running gear assembly.

10. A pivoted bogie running gear assembly as set forth in claim 9 wherein said transverse cross piece (31) includes a central middle section (50, 51, 52) connecting said traverse crossbars (46, 47) below said pendulum carrier (30).

11. A pivoted bogie running gear assembly as set forth in claim 10 wherein said frame (2) includes a lemniscate guide connected to said central middle section (50, 51, 52) allowing said central middle section (50, 51, 52) to receive longitudinal forces and said transverse cross piece (31) to rotate outwards about a substantially vertical axis to deflect in a substantially transverse manner with respect to the direction of travel.

12. A pivoted bogie running gear assembly as set forth in claim 11 including active transverse springs (32, 33) and damping elements (34, 35) connecting said frame (2) to said pendulum carrier (30) fore and aft thereof.

13. A pivoted bogie running gear assembly as set forth in claim 12 wherein said traverse crossbars (46, 47) include orifices (88, 89) to receive said pendulum carrier (30) therethrough.

14. A pivoted bogie running gear assembly as set forth in claim 13 wherein said pendulum carrier (30) includes a connecting part (36, 37) to extend through said orifices (88, 89) below said traverse crossbars (46, 47) forward and rearward thereof.

15. A pivoted bogie running gear assembly as set forth in claim 14 wherein said pendulum carrier (30) includes a roll stabilizing system preventing said pendulum carrier (30) from rolling, said roll stabilizing system including roll stabilizer levers (40, 41).

16. A pivoted bogie running gear assembly as set forth in claim 15 wherein said roll stabilizing system includes pull-push rods (42, 43) connecting said roll stabilizer levers (40, 41) to said pendulum carrier (30).

17. A pivoted bogie running gear assembly as set forth in claim 16 wherein said roll stabilizing system further includes torsion rods (38, 39) for resiliently connecting each of said stabilizing levers (40, 41) to each other.

18. A pivoted bogie running gear assembly as set forth in claim 17 wherein said roll stabilizing system further includes a damping device (44) for connecting said roll stabilizing system to said frame (2) wherein said damping device (44) engages said stabilizer lever (41) at a distance from an articulation axis thereof.

19. A pivoted bogie running gear assembly as set forth in claim 18 wherein said roll stabilizing system is includes four intermediate levers (40, 41) and struts (42, 43), both of which are disposed in a symmetrical manner about said pivoted bogie running gear assembly.

20. A pivoted bogie running gear assembly as set forth in claim 19 including a rotational movement damping device (83) extending between said frame (2) preventing said pivoted bogie running gear assembly from rotating outwards.

21. A pivoted bogie running gear assembly as set forth in claim 20 wherein said secondary spring system includes air springs (28, 29).

22. A pivoted bogie running gear assembly as set forth in claim 21 wherein said pendulum carrier (30) includes a hollow interior in fluid communication with said air springs (28, 29).

23. A pivoted bogie running gear assembly as set forth in claim 22 including axles (11, 12).

24. A pivoted bogie running gear assembly as set forth in claim 23 wherein each of said axles (11, 12) includes a transverse-lying electric drive (21, 22) attached to said frame (2) such that said transverse-lying electric drive (21, 22) is disposed on the side, facing said pendulum carrier (30) of said axle (11, 12).

25. A pivoted bogie running gear assembly as set forth in claim 24 including a wheel disc brake on a side of said axle (11, 12) facing said pendulum carrier (30).

26. A pivoted bogie running gear assembly as set forth in claim 22 wherein said hollow interior includes sections.

* * * * *

UNITED STATES PATENT AND TRADEMARK OFFICE

CERTIFICATE OF CORRECTION

PATENT NO. : 6,247,413 B1
DATED : June 19, 2001
INVENTOR(S) : Teichmann

It is certified that error appears in the above-identified patent and that said Letters Patent is hereby corrected as shown below:

Title page,
Assignee, "Siemans" should be -- Siemens --;

Column 4,
Line 61, "a the partial" should be -- a partial --; and

Column 11,
Line 7, "an d" should be -- and --.

Signed and Sealed this

Ninth Day of April, 2002

*Attest:*

*Attesting Officer*

JAMES E. ROGAN
*Director of the United States Patent and Trademark Office*